United States Patent [19]

Marvin

[11] Patent Number: 4,832,266

[45] Date of Patent: May 23, 1989

[54] FLUID-JET-CUTTING NOZZLE ASSEMBLY

[76] Inventor: Lyle E. Marvin, R1 Box 341, Galena, Kans. 66739

[21] Appl. No.: 188,502

[22] Filed: Apr. 29, 1988

[51] Int. Cl.[4] ..... B05B 1/14; B05B 1/00; B24C 5/04

[52] U.S. Cl. ..... 239/590.3; 239/591; 51/439

[58] Field of Search ..... 239/590, 590.3, 590.5, 239/591; 51/439; 175/393, 423, 424

[56] References Cited

U.S. PATENT DOCUMENTS

| | | | |
|---|---|---|---|
| 108,408 | 10/1870 | Tilghman | 51/439 X |
| 2,332,407 | 10/1943 | Spenle | 51/439 |
| 2,521,782 | 9/1950 | Escher | 51/439 X |
| 3,994,097 | 11/1976 | Lamb | 51/439 X |
| 4,648,215 | 3/1987 | Hashish | 51/439 |

*Primary Examiner*—Andres Kashnikow

*Assistant Examiner*—Patrick N. Burkhart

[57] ABSTRACT

The Assembly comprises a centrally-bored nozzle, a centrally-bored nozzle body, a centrally-bored jet orifice element, and an orifice element-supporting cylinder, the four being in substantially collinear alignment along a longitudinal axis. The cylinder is disposed in the central bore of the body, and it too has a fluid-accommodating passage formed centrally therethrough, as well as a recess in one end in which to nest the orifice element. The cylinder has a straight shank portion which projects into a void in the nozzle body subsisting between the element and the nozzle. Adjustment screws, in penetration of the nozzle body, are arrayed about the shank portion for manipulation to adjust the attitude of the shank portion relative to the longitudinal axis and, thereby, correctively align the element with the nozzle.

5 Claims, 1 Drawing Sheet

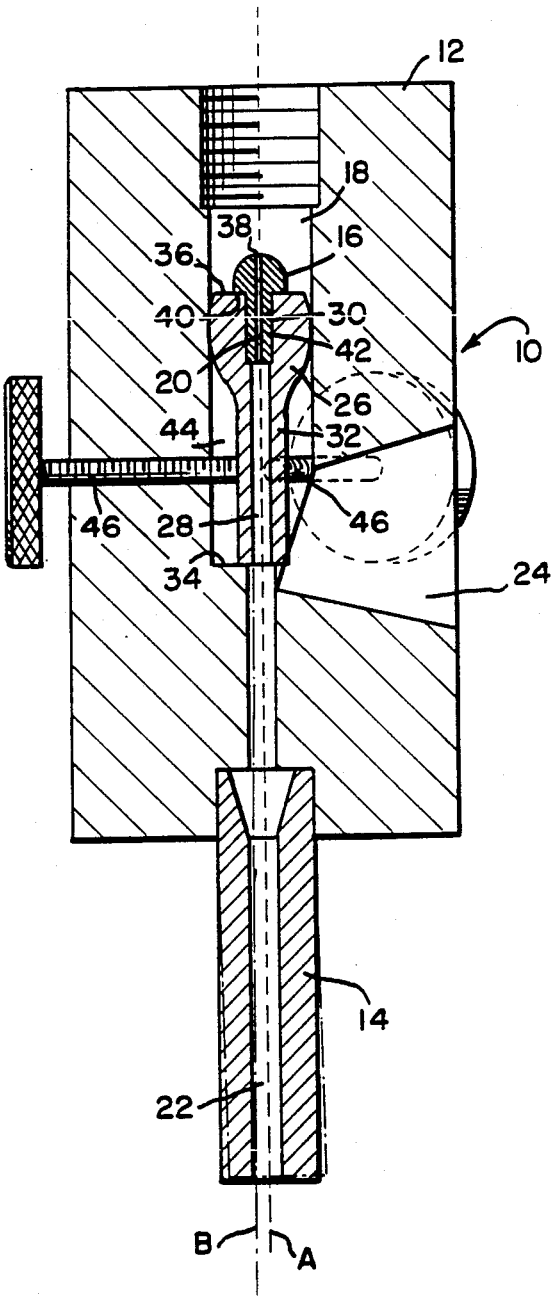
12
18
38
16
36
40
30
42
10
20
26
44
32
46
28
46
34
24
14
22
B
A

FLUID-JET-CUTTING NOZZLE ASSEMBLY

This invention pertains to fluid-jet-cutting apparatus, and in particular to a fluid-jet-cutting nozzle assembly such as is used in such apparatus.

The nozzle assemblies to which this invention pertains commonly comprise a nozzle body, a nozzle, and a jet orifice element, the three being centrally bored and disposed for longitudinal alignment of the bores substantially along an axis.

Due to manufacturing tolerances, and machining imprecisions, it frequently occurs that the jet orifice element and nozzle bores are not in true, axial alignment. Consequently, the highly-pressured fluid jet, passing through the bore in the element, can enter the bore in the nozzle slightly off center, and migrate toward, and impinge against, the wall of the nozzle bore. As a result, and especially if the jet has abrasive particulate therein, the nozzle bore becomes distorted, and the nozzle itself is soon unusable and must be replaced.

What has been needed is a fluid-jet-cutting nozzle assembly which will accommodate for the aforesaid tolerences and imprecisions, by allowing for axial alignment adjustments.

It is an object of this invention to meet just such a need.

It is particularly an object of this invention to set forth a fluid-jet-cutting nozzle assembly, comprising a body; a nozzle; and a jet orifice element; wherein said body, nozzle and element each have a fluid-accommodating passage formed therethrough, and centrally thereof; said body comprises means for (a) receiving said nozzle and element therein, and (b) positioning said nozzle and element therein, in a spaced-apart disposition, with said passages in substantially collinear alignment along a given axis; and further including means disposed in said passage in said body for supporting said element in said alignment; and means supported in said body for selectively adjusting the disposition of said element-supporting means to effect, thereby, alteration of the alignment of said element relative to said axis.

Further objects of this invention, as well as the novel features thereof, will become more apparent by reference to the following description, taken in conjunction with the accompanying FIGURE, the same being a longitudinal cross-section of an embodiment of a fluid-jet-cutting nozzle assembly according to the invention.

As shown in the FIGURE, the assembly 10 comprises a nozzle body 12 which holds a nozzle 14 and a jet orifice element 16 fixed therein in spaced-apart disposition. The body 12, element 16, and nozzle 14 have collinearly-aligned bores or passages 18, 20 and 22, respectively. As is known from prior art, fluid (liquid) under extreme pressure is admitted into passage 18, is formed into a very fine jet stream in element 16, and passes through the passage 22 of the nozzle 14. A side port 24 is provided to admit particulate abrasive for entrainment thereof with the jet stream.

The dashed line "A" denotes the optimum, axial path for the jet stream and the central axis of the assembly. However, if (due to abusive use) the nozzle 14 is deflected, or if manufacturing tolerances and machining imprecisions result in misalignments of the element 16 and/or nozzle 14, the actual stream path will be as shown as line "B". This causes deformation of the nozzle bore 22 and if abrasive particulate is employed, especially, the nozzle 14 is soon eroded and useless.

According to my invention, the misalignments can be overcome in a very facile manner. Within bore or passage 18 of the body 12 is disposed a cylindrical component 26. The latter has a central passage 28 formed therethrough, a recess 30 in the upstream end thereof, and a straight shank 32 directed toward the nozzle 14. The end of the shank 32 slidably rests on a land 34 formed in the body 12. A flat bearing surface 36 rims the recess 30.

The jet orifice element 16 has a head 38 with a flat, underlying shoulder 40, and a straight shank 42 extending from the shoulder. The shank 42 is set into the recess 30, and the shoulder 40 is set on the bearing surface 36.

The shank 32 of the component 26 is disposed within a walled void 44 formed in the body 12. Three screws 46 (only two are visible) are in penetration of the wall of body 12 and are arrayed about the shank 32.

By turning the proper screws 46, the shank can be displaced, relative to the axis A, to align the path of the stream exiting the element 16 with the bore 22 of the nozzle 14—as necessary, due to any axial misalignment of the nozzle 14 or element 16.

While I have described my invention in connection with a specific embodiment thereof, it is to be clearly understood that this is done only by way of example and not as a limitation to the scope of my invention as set forth in the objects thereof and in the appended claims.

I claim:

1. A fluid-jet-cutting nozzle assembly, comprising: p1 a body;

a nozzle; and a jet orifice element; wherein said body, nozzle and element each have a fluid-accommodating passage formed therethrough, and centrally thereof;

said body comprises means for (a) receiving said nozzle and element therein, and (b) positioning said nozzle and element therein in a spaced-apart disposition, with said passages in substantially collinear alignment along a given axis; and further including means disposed in said passage in said body for supporting said element in said alignment; and means supported in said body for selectively adjusting the disposition of said element-supporting means to effect, thereby, alteration of the alignment of said element relative to said axis; wherein said body has a land formed therewithin;

said element-supporting means has a terminal end thereof in slidable, resting engagement with said land; and said adjusting means comprises means for sluing said terminal end, slidably, about said land.

2. An assembly, according to claim 1, wherein:

said element-supporting means comprises a cylinder;

said cylinder has a fluid-accommodating passage formed therethrough, and centrally thereof, and a recess formed in an end thereof; and said element has a portion thereof set in said recess.

3. A fluid-jet-cutting nozzle assembly, comprising:

a body;

a nozzle; and a jet orifice element; wherein said body, nozzle and element each have a fluid-accommodating passage formed therethrough, and centrally thereof;

said body comprises means for (a) receiving said nozzle and element therein, and (b) positioning said nozzle and element therein in a spaced-apart disposition, with said passages in substantially collinear alignment along a given axis; and further including means disposed in said passage in said body for supporting said element in said alignment; and means supported in said body for selectively adjusting the disposition of said element-supporting means to effect, thereby, alteration of the alignment of said element relative to said axis; wherein said element-supporting means comprises a cylinder;

said cylinder has a fluid-accommodating passage formed therethrough, and centrally thereof, and a recess formed in an end thereof;

said element has a portion thereof set in said recess;

said cylinder has a flat bearing surface, at said end thereof, which rims said recess;

said element has a head, with a flat, underlying shoulder, and a straight shank extending from said shoulder; and said shank is set in said recess, and said shoulder is set on said bearing surface.

4. An assembly, according to claim 3, wherein:

said body has a void formed therein, between said element and said nozzle, and a circumferential wall about said void;

said cylinder has a shank portion which projects into said void; and said adjusting means comprises means which penetrates said wall, and intrudes into said void, for engaging and displacing said shank portion of said cylinder.

5. A nozzle assembly, according to claim 4, wherein:

said engaging and displacing means comprises a plurality of adjustment screws arrayed about said shank portion of said cylinder.

* * * * *